US009222312B2

(12) United States Patent
Anderson

(10) Patent No.: US 9,222,312 B2
(45) **Date of Patent: *Dec. 29, 2015**

(54) VIBRATING DOWNHOLE TOOL

(75) Inventor: Charles Abernethy Anderson, Millarville (CA)

(73) Assignee: CT Energy Ltd. (CA)

( * ) Notice: Subject to any disclaimer, the term of this patent is extended or adjusted under 35 U.S.C. 154(b) by 682 days.

This patent is subject to a terminal disclaimer.

(21) Appl. No.: 13/381,297

(22) PCT Filed: Jun. 9, 2010

(86) PCT No.: PCT/CA2010/001022

§ 371 (c)(1),
(2), (4) Date: Mar. 15, 2012

(87) PCT Pub. No.: WO2011/000102

PCT Pub. Date: Jan. 6, 2011

(65) Prior Publication Data

US 2012/0193145 A1 Aug. 2, 2012

Related U.S. Application Data

(63) Continuation-in-part of application No. 12/458,005, filed on Jun. 29, 2009, now Pat. No. 8,162,078.

(30) Foreign Application Priority Data

Nov. 27, 2009 (WO) ..... PCT/CA2009/001697

(51) Int. Cl.
*E21B 7/24* (2006.01)
*E21B 21/10* (2006.01)
*E21B 28/00* (2006.01)

(52) U.S. Cl.
CPC ..... *E21B 7/24* (2013.01); *E21B 21/103* (2013.01); *E21B 28/00* (2013.01)

(58) Field of Classification Search
CPC ..... E21B 7/24; E21B 21/103
USPC ..... 175/55, 56; 166/177.6, 177.7, 177.1, 166/177.2
See application file for complete search history.

(56) References Cited

U.S. PATENT DOCUMENTS 3,648,786 A 3/1972 Chenoweth
3,764,968 A 10/1973 Anderson
(Continued)

FOREIGN PATENT DOCUMENTS

EP 0 131 451 1/1985
GB 1195862 6/1970

OTHER PUBLICATIONS

ISR, PCT/CA2010/001022, CT Energy Ltd. et al, Sep. 21, 2010.
(Continued)

*Primary Examiner* — Giovanna C Wright
(74) *Attorney, Agent, or Firm* — Scott T. Griggs; Griggs Bergen LLP

(57) ABSTRACT

Disclosed is an apparatus for vibrating a downhole drill string operable to have a drilling fluid pumped therethrough. The apparatus comprises a tubular body securable to the drill string and having a central bore therethrough, a valve in the tubular body for venting the drilling fluid out of the drill string and a valve actuator for cyclically opening and closing the valve. The method comprises pumping a drilling fluid down the drill string and cyclically venting the drilling fluid through the valve so as to cyclically reduce the pressure of the drilling fluid in the drill string. The valve can comprise a tubular body port and a corresponding rotor port selectably alignable with the tubular body port as the rotor rotates within the central bore. The valve actuator can comprise at least one vane on the rotor for rotating the rotor as the drilling fluid flows therepast.

19 Claims, 11 Drawing Sheets

(56) References Cited

U.S. PATENT DOCUMENTS

| | | | | |
|---|---|---|---|---|
| 4,033,429 | A | 7/1977 | Farr | |
| 4,058,163 | A | 11/1977 | Yandell | |
| 4,351,037 | A | 9/1982 | Scherbatskoy | |
| 4,686,658 | A | 8/1987 | Davison | |
| 4,734,892 | A | 3/1988 | Kotlyar | |
| 4,775,016 | A | 10/1988 | Barnard | |
| 4,890,682 | A | 1/1990 | Worrall et al. | |
| 4,953,595 | A | 9/1990 | Kotlyar | |
| 5,357,483 | A | 10/1994 | Innes | |
| 5,787,052 | A | 7/1998 | Gardner et al. | |
| 6,279,670 | B1 | 8/2001 | Eddison et al. | |
| 6,289,998 | B1 | 9/2001 | Krueger et al. | |
| 6,298,916 | B1 * | 10/2001 | Tibbles et al. | 166/278 |
| 6,431,294 | B1 | 8/2002 | Eddison et al. | |
| 6,439,318 | B1 | 8/2002 | Eddison et al. | |
| 6,508,317 | B2 | 1/2003 | Eddison et al. | |
| 6,571,870 | B2 | 6/2003 | Zheng et al. | |
| 6,714,138 | B1 | 3/2004 | Turner et al. | |
| 7,011,156 | B2 | 3/2006 | von Gynz-Rekowski | |
| 7,077,205 | B2 | 7/2006 | Eddison | |
| 7,139,219 | B2 | 11/2006 | Kolle et al. | |
| 7,219,726 | B2 | 5/2007 | Zheng et al. | |
| 7,327,634 | B2 | 2/2008 | Perry et al. | |
| 7,417,920 | B2 | 8/2008 | Hahn et al. | |
| 8,215,403 | B1 * | 7/2012 | Penisson | 166/331 |
| 2009/0272580 | A1 * | 11/2009 | Dolman et al. | 175/48 |

OTHER PUBLICATIONS

Supplementary European Search Report, European Patent Office, Jun. 29, 2015.

* cited by examiner

VIBRATING DOWNHOLE TOOL

CROSS REFERENCE TO RELATED APPLICATIONS

This application claims priority of U.S. patent application Ser. No. 12/458,005 filed Jun. 29, 2009 and PCT Patent Application No. PCT/CA2009/001697 filed Nov. 27, 2009 and hereby incorporates these applications by reference herein in their entirety.

BACKGROUND OF THE DISCLOSURE

1. Field of Disclosure

The present disclosure relates to vibrating tools in general, and in particular to a method and apparatus for vibrating a downhole tool in a drill string.

2. Description of Related Art

In the field of drilling, friction may frequently impair the ability of the drill string to be advanced within the hole. For example, highly deviated holes or horizontal drilling cannot rely on the weight of the drill pipe alone to overcome friction from the horizontal pipe resting against the wall of the hole.

Conventional vibration tools have alternatingly increased the pressure of the drilling fluid within the drill string by cyclically blocking and unblocking the flow of the drilling fluid within the drill string. Such devices accordingly cyclically increase the pressure of the drilling fluid within the drill string and then release it. Such devices disadvantageously require a high supply pressure over and above the supply pressure for the drilling fluid. This increases cost and complexity of the machinery required to support this operation. In addition, many conventional vibration tools involve complex downhole systems and devices which may be more prone to breakage.

Many such conventional vibration tools also create back-pressure in the drilling fluid supply. This has the negative consequences of requiring supply pumps of greater capacity and also reduces the supply pressure to the drilling bit. Still other apparatuses have utilized blunt mechanical impacts which increases the wear life and the complexity of the design.

SUMMARY OF THE DISCLOSURE

In some embodiments there is disclosed a method of vibrating a downhole drill string. The method can comprise pumping a drilling fluid down the drill string and cyclically venting the drilling fluid through a valve disposed in a side wall of the drilling string so as to cyclically reduce the pressure of the drilling fluid in the drill string.

In some embodiments, the method can further comprise rotating at least one rotor within a tubular body disposed in-line within the drill string wherein the venting can comprise intermittently passing the drilling fluid through a rotor port disposed in the rotor and a corresponding tubular body port disposed in the tubular body. The rotor can be rotated by the drilling fluid.

In some embodiments, the method can further comprise separating the drilling fluid into a central bypass portion and an annular rotor portion, the bypass portion can flow past the rotor, and the rotor portion can rotate the rotor. The bypass portion and the rotor portion can be combined after the rotor portion rotates the rotor, wherein the combined rotor portion and the bypass portion can pass through the rotor port and the tubular port.

According to a further embodiment, there is disclosed an apparatus for vibrating a downhole drill string. The drill string is operable to have a drilling fluid pumped therethrough. The apparatus can comprise a tubular body securable to the drill string and having a central bore therethrough, a valve disposed in the tubular body for venting the drilling fluid out of the drill string and a valve actuator for cyclically opening and closing the valve.

The valve can comprise a radial tubular body port in the tubular body and at least one rotor located within the central bore having a radial rotor port wherein the rotor port is selectably alignable with the tubular body port as the rotor rotates within the central bore. The valve actuator can comprise at least one vane on the rotor for rotating the rotor as the drilling fluid flows therepast. The rotor can include a central bypass bore therethrough and a plurality of vanes radially arranged around the central bypass bore.

The apparatus can further comprise a separator for separating the drilling fluid into a bypass portion and a rotor portion secured within the central bore, the rotor portion being directed onto the plurality of vanes so as to rotate the rotor, the bypass portion being directed though the bypass bore of the rotor. The separator can include a central bypass port and an annular rotor passage therearound. The separator can be located adjacent to the rotor such that the central bypass port of the separator directs the bypass portion of the drilling fluid though the bypass bore of the rotor and wherein the rotor passage of the separator directs the rotor portion of the drilling fluid onto the plurality of vanes of the rotor. The rotor passage of the separator can include stator vanes for directing the rotor portion of the drilling fluid onto the plurality of vanes.

The apparatus can further comprise a plurality of rotor ports selectably alignable with a plurality of tubular body ports. Each of the plurality of rotor ports can be selectably alignable with a unique tubular body port.

The tubular body can be connectable inline within a drill string. The tubular body can include threaded end connectors for linear connection within a drill string.

The bypass port of the separator can include an inlet shaped to receive a blocking body so as to selectably direct more drilling fluid through the rotor passage. The inlet can have a substantially spherical shape so as to receive a spherical blocking body.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
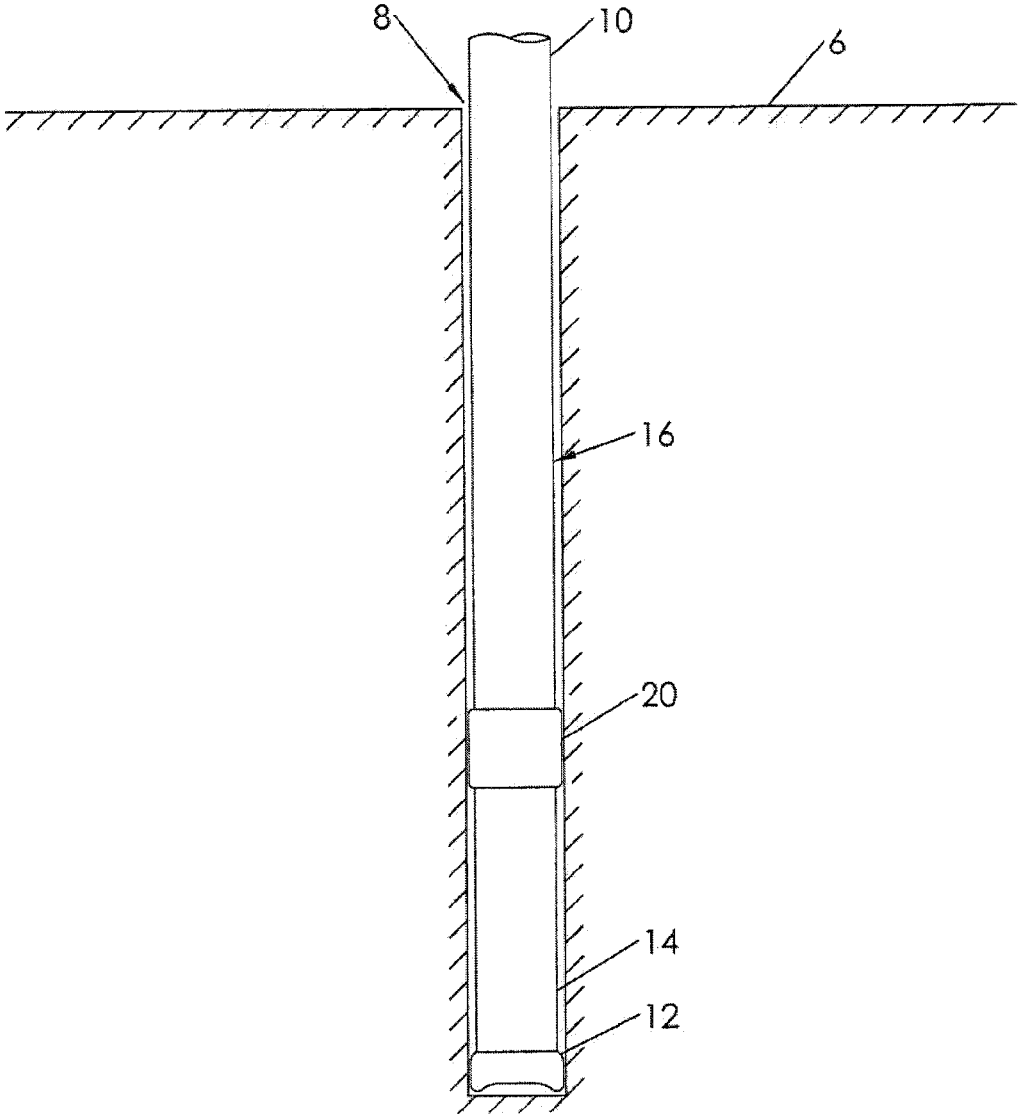
FIG. 1 is a perspective view of the vibrating downhole tool located within a drill string.

Referring to FIG. 1, a drill string 10 is illustrated down a bore hole 8 in a soil or rock formation 6. The drill string includes a drill bit 12 at a lower end 14 thereof and an apparatus according to an embodiment shown generally at 20 for vibrating the drill string within the bore hole 8. The apparatus 20 can be located proximate to the lower end 14 of the drill string 10 or at an intermediate portion 16 of the drill string 10. It will also be appreciated that a plurality of apparatuses 20 can be located at a plurality of locations along the drill string.

Figure 2:
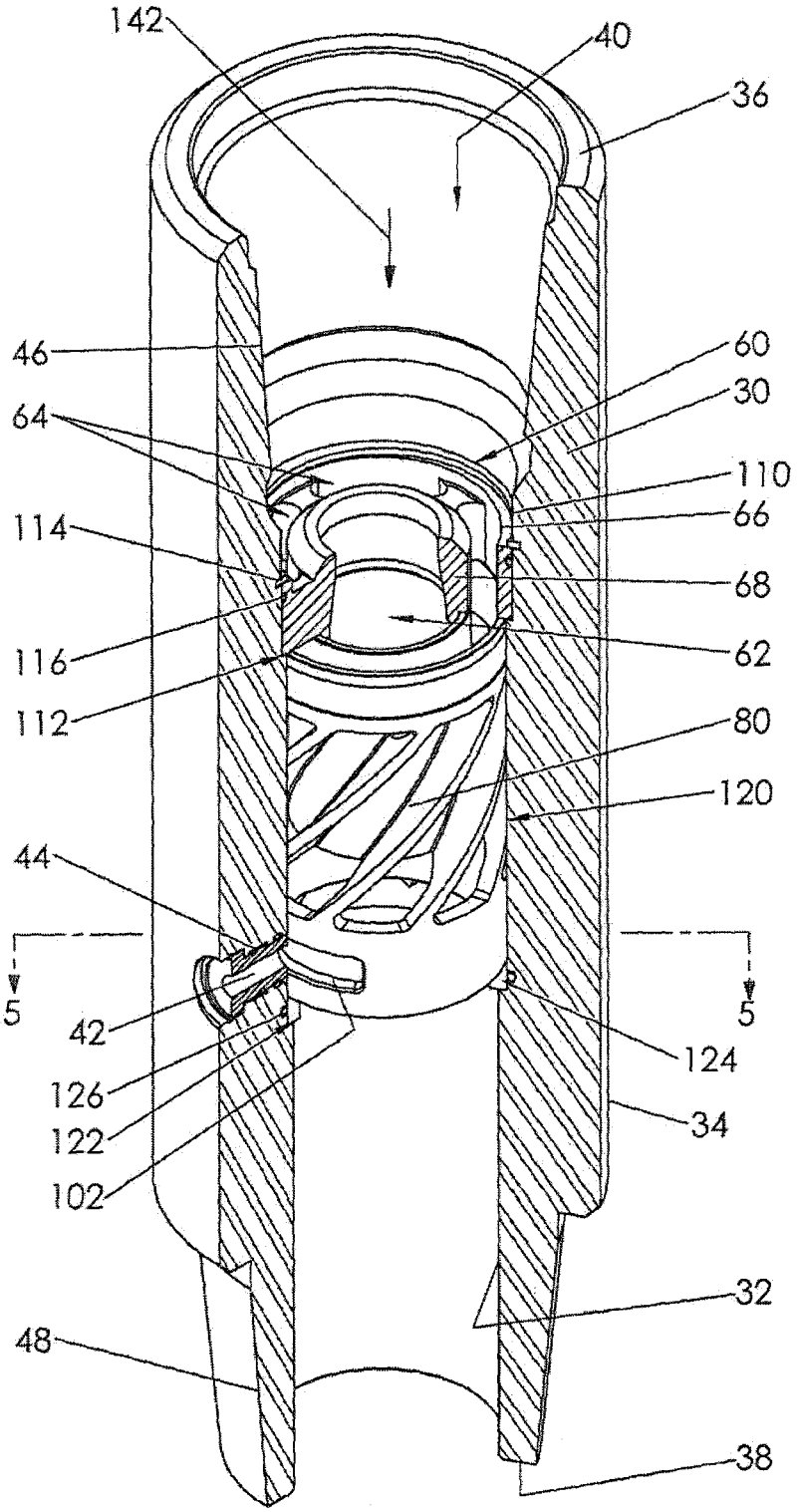
FIG. 2 is a partial cross-sectional perspective view of a vibrating downhole tool according to an embodiment.

Turning now to FIG. 2, the apparatus 20 comprises a tubular body 30, a flow separator 60 and a rotor 80. The tubular body 30 has a cylindrical wall 31 having inner and outer surfaces 32 and 34, respectively extending between inlet and outlet ends, 36 and 38, respectively. The inner surface 32 defines a central bore 40. The tubular body 30 includes at least one radial tubular body port 42 extending therethrough. The tubular body port 42 can be formed as a bore through the wall 31 or can optionally be located within a tubular body port insert 44 as illustrated in FIG. 2. The use of a tubular body port insert 44 facilitates the interchangability of tubular body port 42 of differing sizes as will be further described below.

As illustrated the tubular body port insert 44 can be threadably secured within the wall 31 or by any other suitable means, such as by way of non-limiting example, compression fit, latches, retaining clips or the like. As illustrated, the tubular body port 42 can have a throttling cross section such that the tubular body port 42 is wider proximate to the interior surface 32 of the tubular body than proximate to the exterior surface 34. The use of a throttling cross section will assist in controlling the volume of drilling fluid vented therethrough. The tubular body port insert 44 can be sealed to the tubular body 30 with an o-ring to prevent washout and backed with a snap ring to prevent the tubular body port insert 44 from backing out.

The inlet and outlet ends 36 and 38 of the tubular body 30 can include interior and exterior threading 46 and 48, respectively, for securing the tubular body in-line with the drill string 10. It will be appreciated that the interior and exterior threading 46 and 48 will be of a conventional type, such as a pin/box type to facilitate ready connection with the drill string 10. The tubular body 30 can be of steel construction, or of any other suitable material, and can be surface hardened for durability and abrasion resistance.

The flow separator 60 comprises a disk shaped body having a central bypass passage 62 and a plurality of rotor passages 64 distributed radially around the bypass passage. The flow separator 60 is sized to be located within the central bore 40 of the tubular body as illustrated in FIG. 2.

Figure 3:
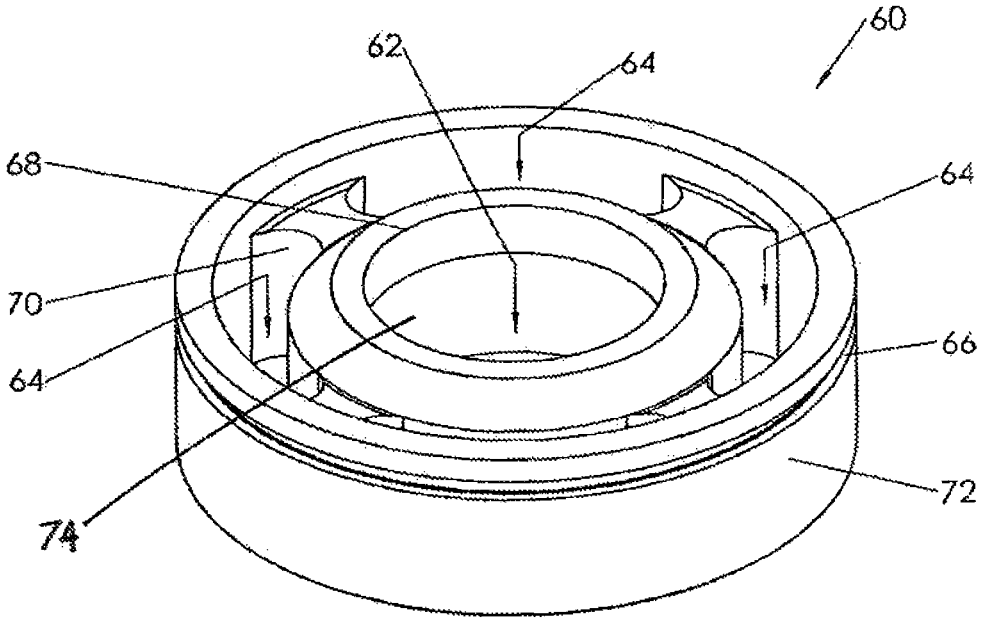
FIG. 3 is a perspective view of a separator of the apparatus of FIG. 2.

Turning now to FIG. 3, the flow separator 60 comprises an outer cylinder 66 and an inner cylinder 68 with a plurality of radial support arms 70 extending therebetween. The outer cylinder 66 includes an outer surface 72 sized to be securely received within the central bore 40 of the tubular body 30. The inner cylinder includes an inner surface 74 defining the bypass passage. The inner cylinder 68, outer cylinder 66 and the support arms 70 define the rotor passages 64.

Figure 4:
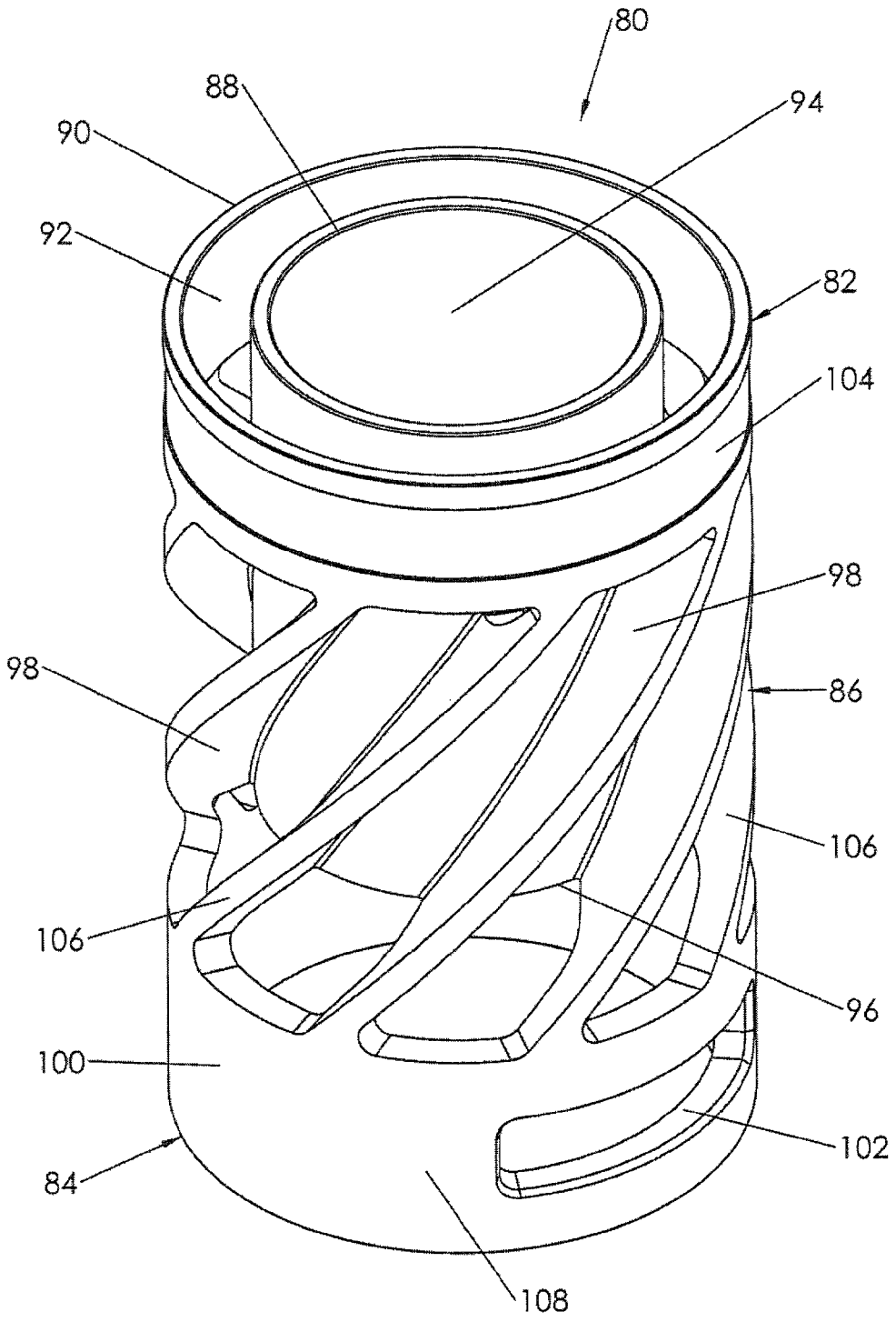
FIG. 4 is a perspective view of a rotor of the apparatus of FIG. 2.

With reference to FIG. 4, the rotor 80 comprises a substantially cylindrical body having inlet and outlet sections, 82 and 84, respectively and a turbine section 86 therebetween. The rotor inlet section 82 of the rotor comprise an outer sleeve 90 and a bypass cylinder 88 defining an annular rotor passage 92 therebetween. The outer sleeve 90 includes an outer surface 104. The bypass cylinder 88 defines a bypass passage 94 therethrough and as a distal end 96 extending substantially into the turbine section 86 as illustrated in FIG. 4. The turbine section 86 comprises a plurality of vanes 98 extending angularly from the inlet to outlet sections 82 and 84. Proximate to the inlet section 82, the vanes 98 extend between the outer sleeve 90 and the bypass cylinder 88 so as to provide support for the bypass cylinder. The vanes 98 include an exterior surface 106 corresponding to the outer surface 104 of the outer sleeve 90. The outlet section 84 can include an outlet sleeve 100 which can have a rotor port 102 in a sidewall thereof. The outlet sleeve 100 can have an outer surface 108. The outer surfaces of the outer sleeve 90, the vanes 98 and the outlet sleeve 100 can act as a bearing surface to permit the rotor 80 to freely rotate within the central bore 40 of the tubular body 30. The rotor 80 can be formed of any suitable material such as steel and can be surface hardened for resistance to impact and surface abrasion. The rotor can be machined as a single component. Alternatively, the rotor can be formed of a plurality of components which are fastened, welded or otherwise secured to each other.

The apparatus 20 can be assembled by rotatably locating the rotor 80 and fixably locating the fluid separator 60 within central bore 40 of the tubular body. The rotor is located such that the rotor port 102 can be alignable with the tubular body port 42 and the flow separator 60 can be located adjacent to the inlet section of the rotor 80. The separator rotor passages 64 can direct drilling fluid into the rotor passage 92 of the rotor while the bypass passage 62 of the flow separator 60 directs a bypass portion of the drilling fluid through the bypass passage 94 of the rotor. The rotor portion of the drilling fluid passed through the rotor passage 92 of the rotor will encounter the vanes 98 thereby causing the rotor 80 to rotate. As the rotor 80 rotates within the tubular body 30, the rotor port 102 will be intermittently aligned with the tubular body port 42 as to intermittently jet a portion of drilling fluid therethrough. Each ejection of drilling fluid through the rotor port 102 and tubular body port 42 can cause a reduction of the pressure of the drilling fluid within the drill string and a corresponding low pressure wave through such drilling fluid. The intermittent ejection of the drilling fluid will create a resonant frequency to be established within the drilling fluid from the multiple low pressure pulses. The multiple pulses causes a vibration to be transmitted from the drilling fluid to the drill string 10 so as to vibrate the drill string 10 within the bore hole 8.

With reference to FIG. 2, the central bore 40 of the tubular body 30 can have an inlet section 110 sized to receive the flow separator 60 snugly therein. The inlet section 110 can end at a first shoulder 112 for retaining the flow separator within the inlet section of the central bore 40. The flow separator can also be retained against the first shoulder 112 by a snap ring 114 or other suitable means. The flow separator 60 can also be sealed within the inlet section 110 by an o-ring 116 or other suitable means. The central bore 40 also includes a rotor portion 120 sized to rotatably receive the rotor 80 therein. The rotor portion 120 ends in a second shoulder 122 for retaining the rotor 80 within the rotor section 120. The flow separator 60 serves to retain the rotor 80 against the second shoulder. The apparatus can also include a wear ring 124 sized to abut against the second shoulder 122 and provide an enlarged surface to retain the rotor 80 within the rotor section 120. The wear ring 124 can be sealed within the rotor section by an o-ring 126 or the like. As shown in FIG. 2, the wear ring 124 can function as a thrust bearing against the rotor 80. The wear ring 124 can be easily replaceable and expendable. Grooves in the bearing surface can help prevent debris from collecting on the bearing surface, thus improving the wear rate. Multiple material types can be used depending on the application. Alternative bearing types such as rolling element bearings are also applicable. The rotor 80 and the flow separator 60 can be inserted into the tubular body 30 through the inlet end 36 of the apparatus and are sized to fit through the internal threading 46.

As described above, the flow separator 60 is a flow distributing device which directs a prescribed amount of drilling fluid flow through to the vanes 98 of the rotor 80. As illustrated in FIG. 2, drilling fluid is pumped downwards within the drill string 10 and therefore through the apparatus 20 as indicated generally at 142. By correctly sizing or adjusting the rotor passage 64 the flow separator will direct sufficient flow through the rotor 80 to allow the rotor to spin at the desired rotational speed. The remaining flow is directed through the bypass passage 62 and subsequently through a bypass passage 94 of the rotor 80. The diameter of the bypass passage 62 can be adjusted to allow for variations in fluid flow rate and fluid properties. The bypass passage 62 of the flow separator 60 can also be included in a threaded orifice plug (with or without a centre bore) in the centre of the flow separator 60 to permit the bypass passage 62 size to be adjusted without replacing the flow separator.

Figure 5:
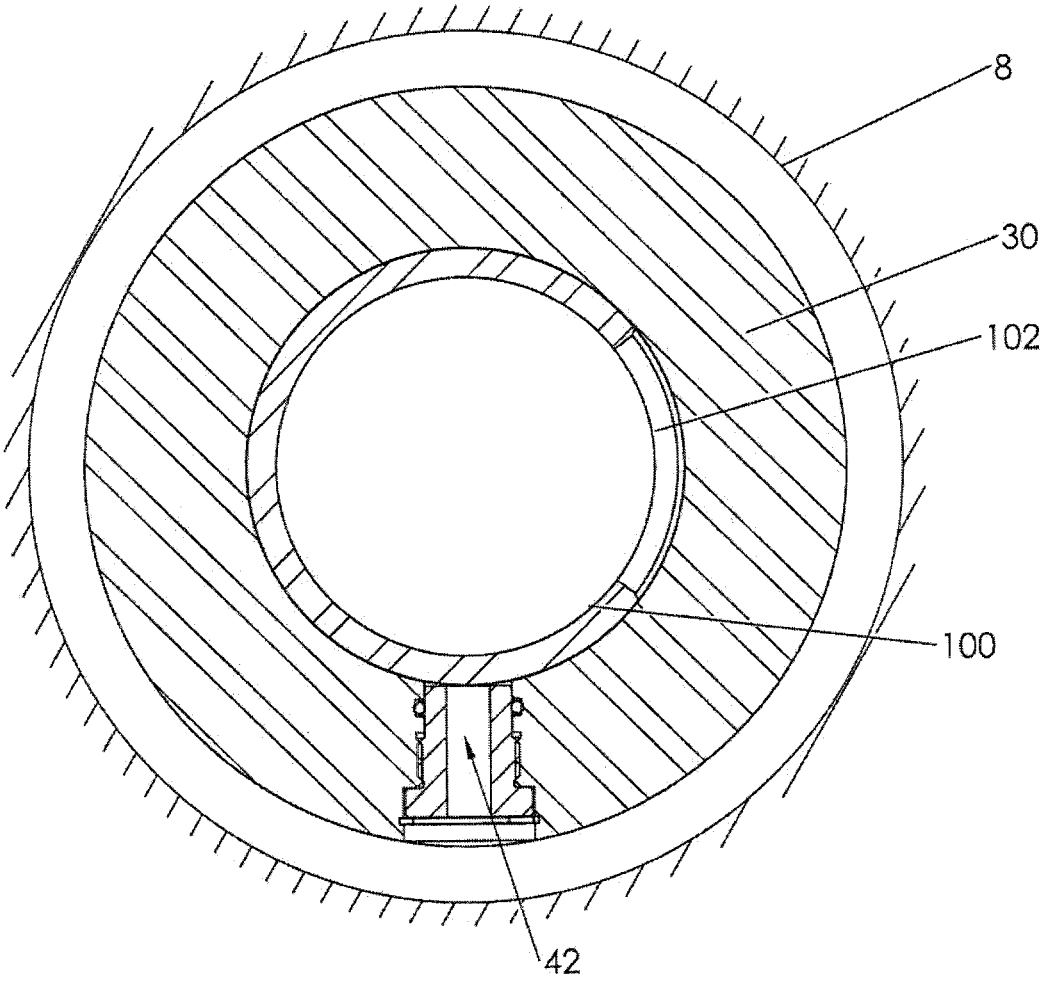
FIG. 5 is a cross sectional view of the apparatus of FIG. 2 taken along the line 5-5 with the rotor at a first position.
Figure 6:
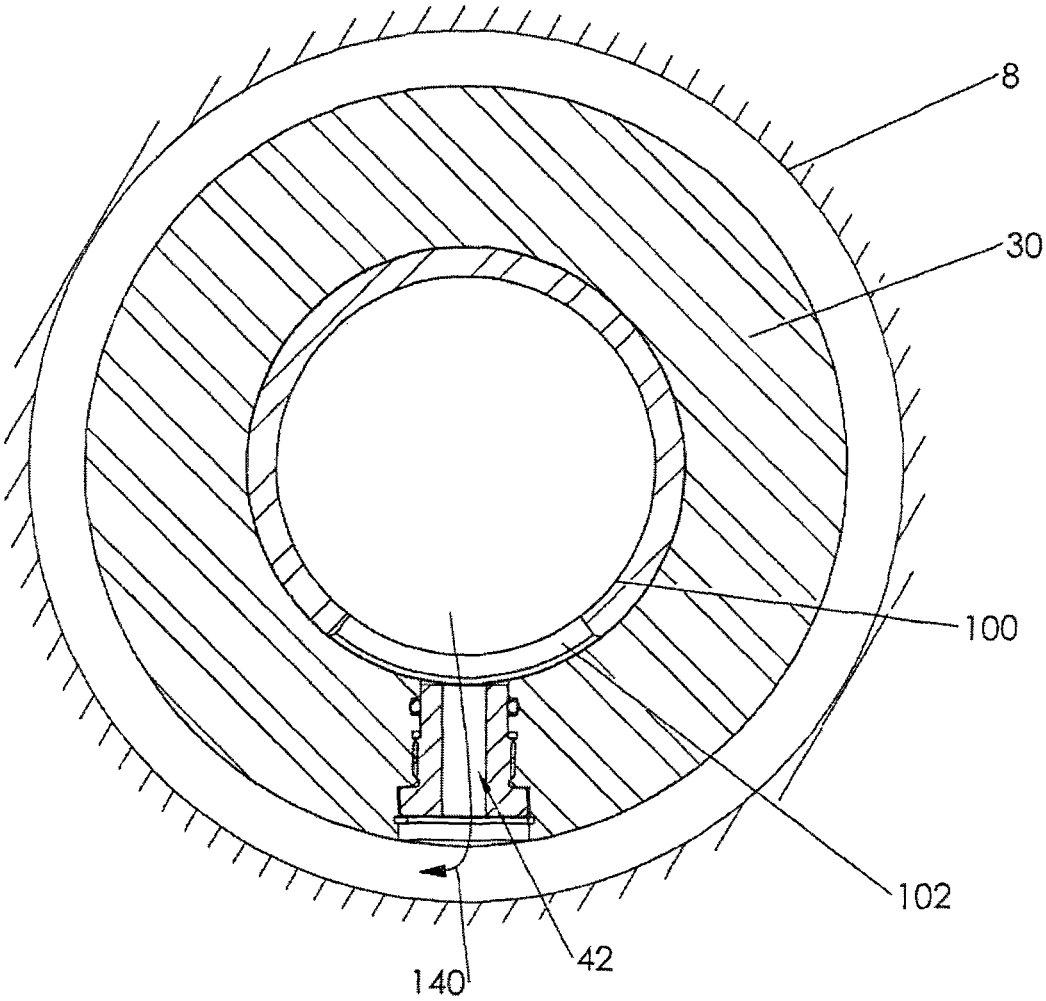
FIG. 6 is a cross sectional view of the apparatus of FIG. 2 taken along the line 5-5 with the rotor at a second position.

The rotor 80 is designed to spin at a set rotational speed. To achieve this, the rotor is designed to be free spinning and rotate at its runaway speed. As the flow enters the rotor 80 through the rotor passage 92 and is then directed onto the vanes 98. The angle of the vanes 98 determine the runaway speed of the turbine for a given flow rate. Closing the bypass passage 94 entirely (i.e. sending all available flow through the rotor passage 92) will allow the rotor to maintain its intended rotational speed should the flow rate be reduced by 50%. As the rotor 80 rotates, drilling fluid is jetted through the rotor port 102 and the tubular body port 42 once per revolution when the rotor port and tubular body port are aligned. As illustrated in FIG. 5, the rotor 80 is illustrated in a first or closed position within the tubular body 30. As illustrated, the rotor port 102 and the tubular body port 42 are not aligned and therefore no drilling fluid is passed therethrough. Turning now to FIG. 6, the rotor is illustrated in a second or open position within the tubular body 30. In the open position, the rotor port 102 and the tubular body port 42 are aligned and therefore the drilling fluid is passed therethrough as indicated generally at 140. The second position is generally referred to herein as a jetting event.

The width of the rotor port 102 determines the duration of the jetting event and can be varied depending on the demands of the application. The diameter of the tubular body port 42 can also be sized to vary the volume of drilling fluid ejected during a jetting event and thereby to vary the impulse delivered to the apparatus 20 by that jetting event. Although one tubular body port 42 is illustrated, it will be appreciated that a plurality of tubular body ports 42 can be utilized. Such plurality of tubular body ports 42 can be located to jet drilling fluid at a common or a different time as desired by the user. Furthermore, the plurality of tubular body ports 42 can be located at different lengthwise locations along the tubular body 30. The rotor port 102 can therefore have a variable width from the top to the bottom such that when a specific tubular body port 42 is selected, the apparatus 20 will have a jetting event length corresponding to the width of the rotor port 102 at that location. All other tubular body ports 42 will therefore be plugged. In other embodiments, a plurality of rotor ports 102 can be utilized each having a unique length and a corresponding tubular body port 42 to produce a jetting event of a desired duration.

Figure 7:
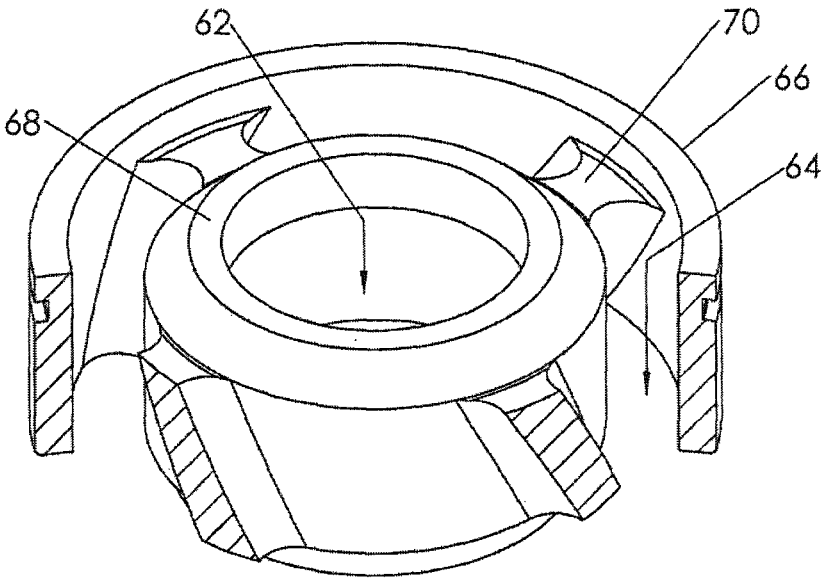
FIG. 7 is a perspective view of the flow separator of the apparatus of FIG. 2 according to a further embodiment.

With reference to FIG. 7, the support arms 70 of the flow separator can be shaped to act as turbine stator blades, thereby increasing the torque capability of the rotor 80. This additional torque may be required for heavy or viscous mud conditions. In a further embodiment, inlet to the bypass passage 62 of the flow separator 60 can also be shaped to allow a blocking body (not shown) to land therein so as to partially block the bypass passage 62 thereby altering the flow distribution and the rotational speed of the turbine. The blocking body can comprise a spherical body although it will be appreciated that other shapes may be useful as well. This can allow the torque capacity/speed of the apparatus to be adjusted during operation, without returning the apparatus to surface.

The apparatus 20 creates pressure fluctuations that induce vibration in a drill string 10 and create a time varying WOB (weight on bit) with a cycling frequency of approximately 15-20 Hz (the natural frequency of the drill string). This vibration or hammering effect reduces wall friction and improves the transfer of force on to the drill bit. The rotor port 102 and the tubular body port 42 function as a valve that is cyclically opened and closed by the rotation of the rotor. It will be appreciated that such a valve function may be provided in another means for venting the drilling fluid from the drill string such as through the use of common valves as known in the art. It will also be appreciated that the tubular body port 42 can be selectably opened by a wide variety of methods. By way of non-limiting example, the tubular body port 42 can be cyclically opened by a solenoid valve or other suitable means or through the use of a motor for rotating the rotor 80. It will be appreciated that in such embodiments, the flow separator 60 and rotor 80 may not be necessary.

Figure 8:
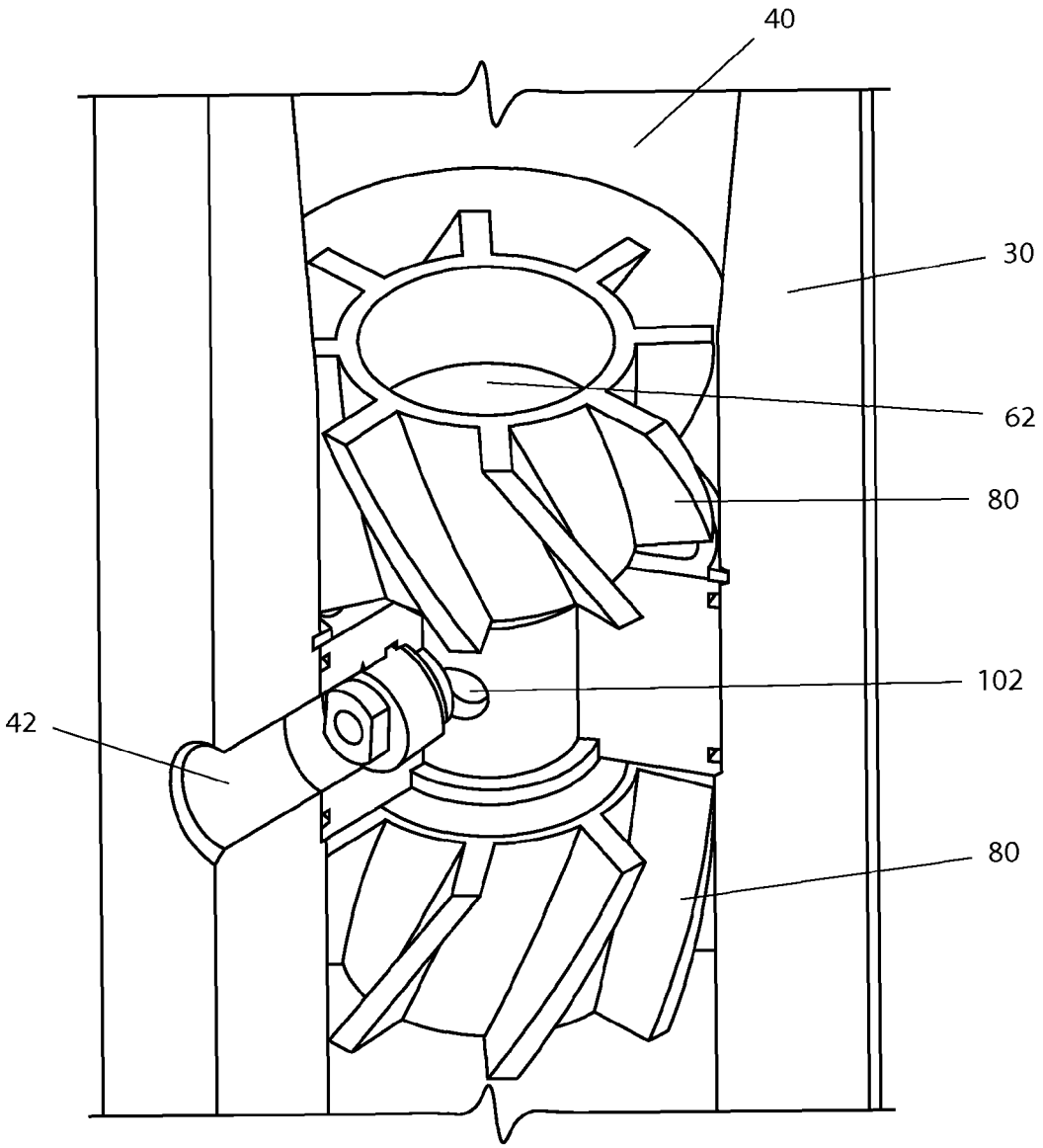
FIG. 8 is a partial cross-sectional perspective view of a vibrating downhole tool according to a further embodiment.
Figure 9:
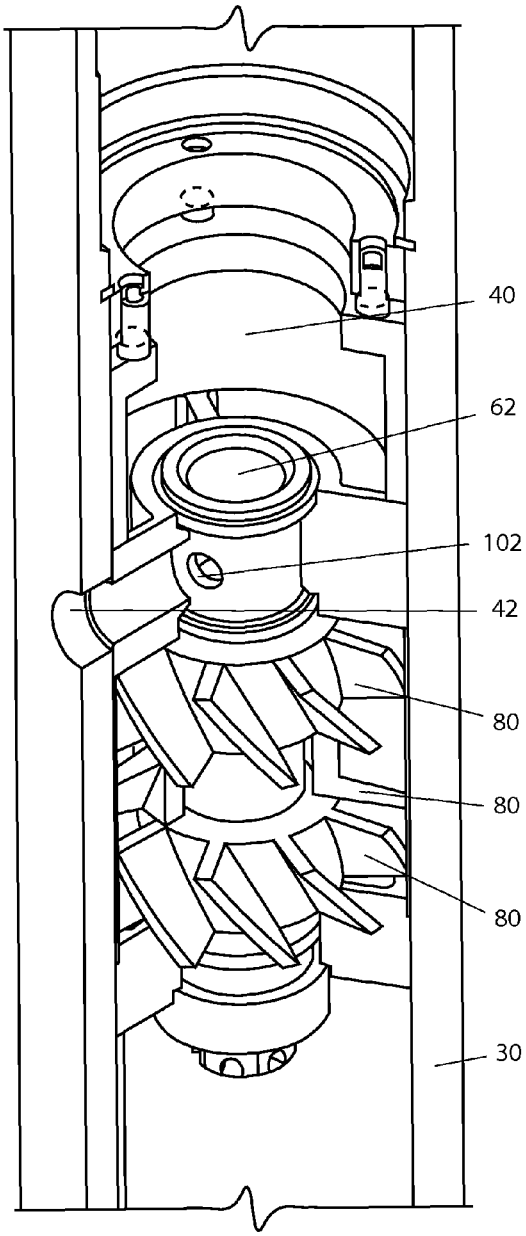
FIG. 9 is a partial cross-sectional perspective view of a vibrating downhole tool according to a further embodiment.
Figure 10:
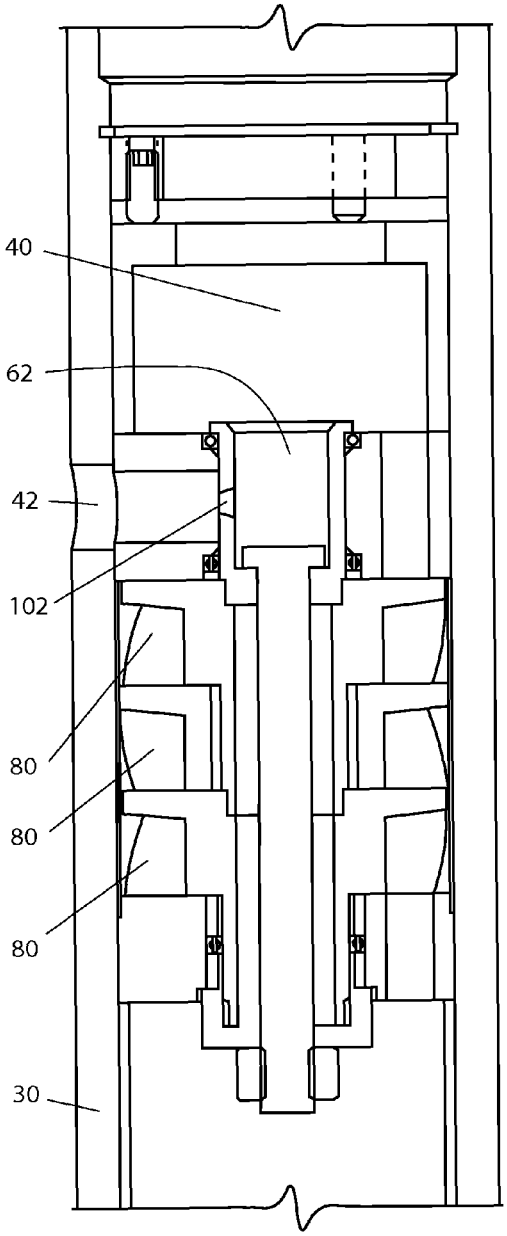
FIG. 10 is a cross sectional view of the apparatus of FIG. 9.
Figure 11:
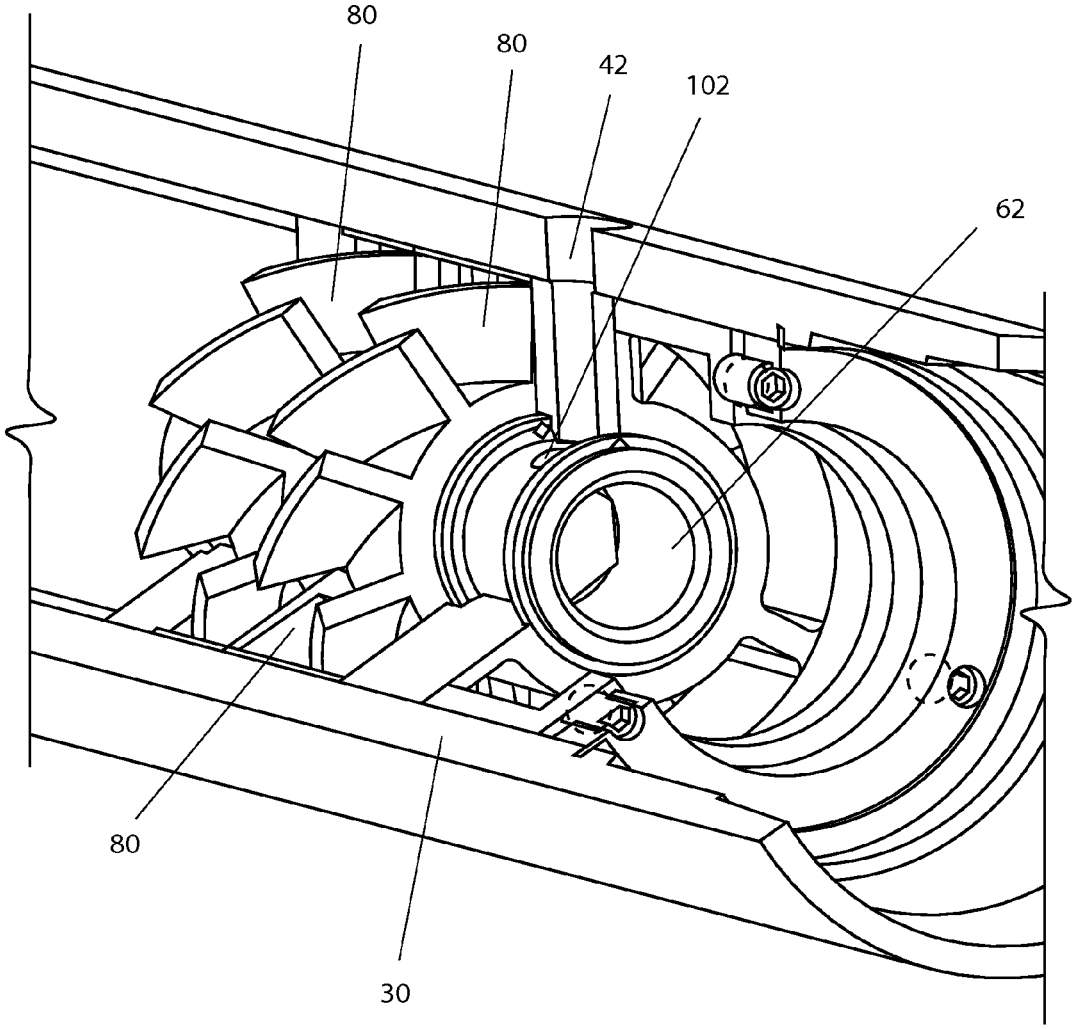
FIG. 11 is a partial cross-sectional perspective view of the apparatus of FIG. 9.
Figure 12:
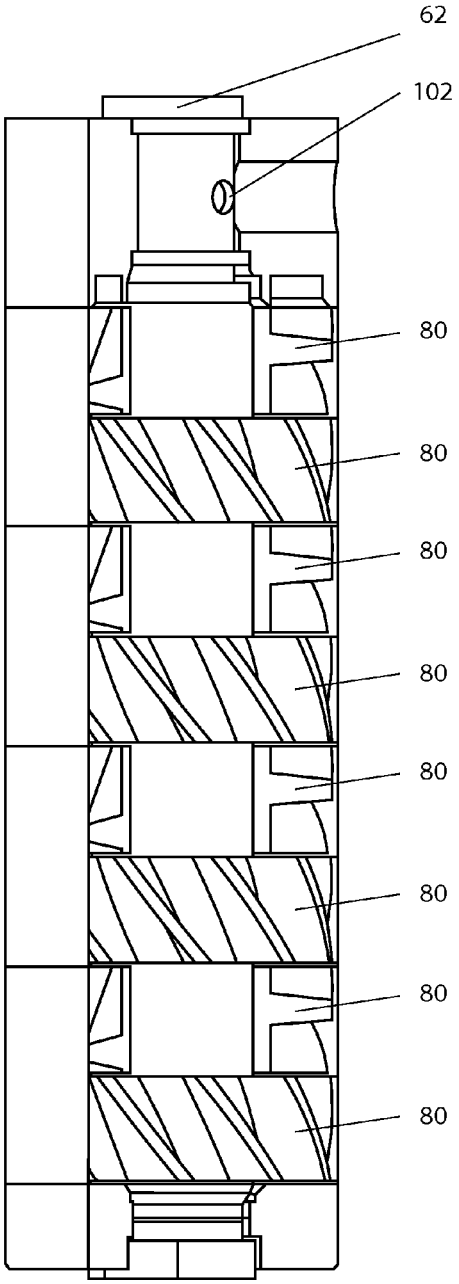
FIG. 12 is a partial cross-sectional view of a vibrating downhole tool according to a further embodiment.
Figure 13:
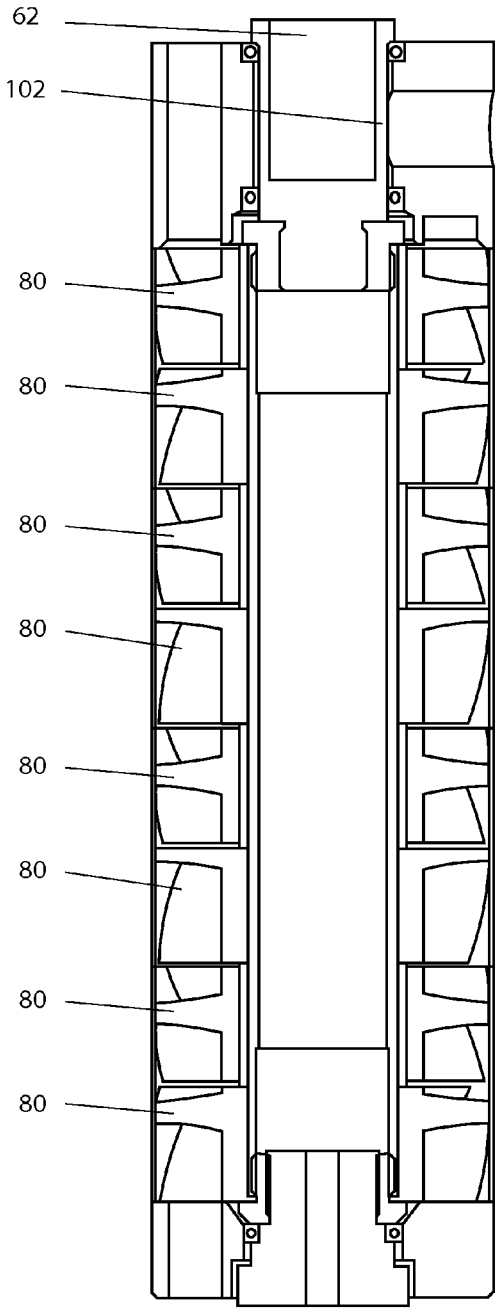
FIG. 13 is a cross sectional view of the apparatus of FIG. 12.

While apparatus 20 has been described above as having one rotor 80, it will be appreciated that in further embodiments, two (FIG. 8) or more (FIGS. 9-13) rotors 80 could be used. The use of multiple rotors 80 can increase the torque and reduce the opposing torque of the apparatus 20. Multiple rotors 80 can be employed in tandem where alternating rotors can be design to rotate in opposite directions. The tandem rotors can act to balance and centralize the apparatus 20. In one embodiment, twelve rotors 80 are employed in tandem within apparatus 20.

While body port 42 and rotor port 102 have been described above as being downstream of rotor 80, it will be appreciated that in further embodiments, body port 42 and rotor port 102 can be located between rotors 80 (FIG. 8) or upstream of rotors 80 (FIGS. 9-13).

While specific embodiments of the invention have been described and illustrated, such embodiments should be considered illustrative of the invention only and not as limiting the invention as construed in accordance with the accompanying claims.

What is claimed is:

1. A method of vibrating a downhole drill string, the method comprising:

pumping a drilling fluid down the drill string; and cyclically venting the drilling fluid through a rotating valve disposed in a side wall of the drill string and cyclically diverting the drilling fluid through the side wall of the drill string, so as to cyclically reduce pressure of the drilling fluid in the drill string.

2. The method of claim 1 further comprising rotating at least one rotor disposed within a tubular body located in-line within the drill string wherein the venting comprises intermittently passing the drilling fluid through a rotor port in the rotor and a corresponding tubular body port in the tubular body.

3. The method of claim 2 further comprising rotating the rotor with the drilling fluid.

4. The method of claim 3 further comprising separating the drilling fluid into a central bypass portion and an annular rotor portion, passing the bypass portion past the rotor, and the rotor portion rotating the rotor.

5. The method of claim 4 wherein the bypass portion and the rotor portion are combined after the rotor portion rotates the rotor wherein the rotor port and the tubular port pass the combined rotor portion and the bypass portion therethrough.

6. An apparatus for vibrating a downhole drill string, the drill string being operable to have a drilling fluid pumped therethrough, the apparatus comprising:

a tubular body securable to the drill string and comprising a central bore extending therethrough;

a rotating valve disposed in the tubular body for venting the drilling fluid out of the drill string;

a radial tubular body port disposed in the tubular body for cyclically diverting the drilling fluid through a sidewall of the drill string; and a passive valve actuator that cyclically opens and closes the rotating valve, so as to cyclically reduce pressure of the drilling fluid in the drill string.

7. The apparatus of claim 6 wherein the valve comprises at least one rotor disposed within the central bore, the rotor comprising a radial rotor port wherein the rotor port is selectably alignable with the tubular body port as the rotor rotates within the central bore.

8. The apparatus of claim 7 wherein the valve actuator comprises at least one vane disposed on the rotor for rotating the rotor as the drilling fluid flows therepast.

9. The apparatus of claim 8 wherein the rotor comprises a central bypass bore therethrough and a plurality of radially spread-apart vanes disposed around the central bypass bore.

10. The apparatus of claim 9 further comprising a separator for separating the drilling fluid into a bypass portion and a rotor portion, the separator disposed within the central bore, the rotor portion being directed onto the plurality of vanes so as to rotate the rotor, the bypass portion being directed through the bypass bore of the rotor.

11. The apparatus of claim 10 wherein the separator further comprises a central bypass port and an annular rotor passage therearound.

12. The apparatus of claim 11 wherein the separator is disposed adjacent to the rotor wherein the central bypass port of the separator directs the bypass portion of the drilling fluid though the bypass bore of the rotor, and wherein the rotor passage of the separator directs the rotor portion of the drilling fluid onto the plurality of vanes.

13. The apparatus of claim 12 wherein the rotor passage of the separator further comprises stator vanes for directing the rotor portion of the drilling fluid onto the plurality of vanes.

14. The apparatus of claim 11 wherein the bypass port of the separator includes an inlet shaped to receive a blocking body so as to selectably direct more drilling fluid through the rotor passage.

15. The apparatus of claim 14 wherein the inlet has a substantially spherical shape so as to receive a spherical blocking body.

16. The apparatus of claim 7 further comprising a plurality of rotor ports selectably alignable with a plurality of tubular body ports.

17. The apparatus of claim 16 wherein each of the plurality of rotor ports is selectably alignable with a unique tubular body port.

18. The apparatus of claim 6 wherein the tubular body is connectable inline within the drill string.

19. The apparatus of claim 18 wherein the tubular body includes threaded end connectors for linear connection within the drill string.

* * * * *

UNITED STATES PATENT AND TRADEMARK OFFICE

CERTIFICATE OF CORRECTION

PATENT NO. : 9,222,312 B2
APPLICATION NO. : 13/381297
DATED : December 29, 2015
INVENTOR(S) : Charles Abernethy Anderson It is certified that error appears in the above-identified patent and that said Letters Patent is hereby corrected as shown below:

Title Page

Item (22) PCT Filed
Change "Jun. 9, 2010" to --Jun. 29, 2010--.

Signed and Sealed this
Twenty-sixth Day of April, 2016

Michelle K. Lee

Michelle K. Lee
*Director of the United States Patent and Trademark Office*